US005992053A

United States Patent [19]

Hansen

[11] Patent Number: 5,992,053

[45] **Date of Patent: *Nov. 30, 1999**

[54] DETACHABLE, CLEATED OUTER SOLE

[76] Inventor: Ross Hansen, 361 Saunders St., Fredericton, N.B., Canada, E3B IN9

[ * ] Notice: This patent is subject to a terminal disclaimer.

[21] Appl. No.: 08/264,976

[22] Filed: Jun. 24, 1994

Related U.S. Application Data

[63] Continuation of application No. 07/616,613, Nov. 21, 1990, Pat. No. 5,335,429.

[51] Int. Cl.[6] ..... A43B 3/10

[52] U.S. Cl. ..... 36/7.5; 36/59 R

[58] Field of Search ..... 36/7.5, 7.6, 114, 36/135, 132, 134, 59 C, 59 R

[56] References Cited

U.S. PATENT DOCUMENTS

| | | | |
|---|---|---|---|
| 2,076,316 | 4/1937 | Beals, Jr. | 36/135 X |
| 2,773,317 | 12/1956 | Helle | 36/59 C X |
| 3,019,533 | 2/1962 | Smith | 36/7.6 |
| 3,747,237 | 7/1973 | Wilowski | 36/59 C |
| 4,387,515 | 6/1983 | Baldwin | 36/135 X |
| 4,525,939 | 7/1985 | McNeil et al. | 36/7.6 |
| 5,077,916 | 1/1992 | Beneteau | 36/114 |
| 5,335,429 | 8/1994 | Hansen | 36/7.5 |

FOREIGN PATENT DOCUMENTS

| | | | |
|---|---|---|---|
| 2140273 | 11/1984 | United Kingdom | 36/135 |

*Primary Examiner*—B. Dayoan

[57] ABSTRACT

An outer-sole to be worn over footwear is characterized by having a curled forward or toe portion, and optionally heel portion as well, that holds the front portion of the outer-sole in contact with the footwear to which it is attached.

16 Claims, 3 Drawing Sheets

DETACHABLE, CLEATED OUTER SOLE

This application is a Continuation of application Ser. No. 07/616,613 filed Nov. 21, 1990, now issued as U.S. Pat. No. 5,335,429 on Aug. 9, 1994.

FIELD OF THE INVENTION

This invention relates to outer soles that are worn by persons over regular footwear. In one format it relates to an outer-sole for persons who wish to minimize the risks of slipping on ice and snow. More particularly, it relates to a method of manufacture and outer-sole product that performs the above function in a superior manner.

BACKGROUND TO THE INVENTION

It has been known for sometime to design anti-slip outer soles that are provided with cleats. This has been generally been done in the form of sandals or some type of clip-on device that is attached beneath the sole portion of regular footwear.

Examples of such an item include the following Canadian patents:

CA: 175,047 to Kirkwood Feb. 19, 1917
223,887 to Roe Sep. 19, 1922
301,313 to Chase Jun. 17, 1930
398,787 to Lawson Aug. 26, 1941
527,399 to Smith Jul. 10, 1956
549,159 to Griffin Nov. 20, 1956
650,756 to Bailey Oct. 23, 1962
669,630 to Smith Sep. 3, 1963
781,673 to Vogt Apr. 2, 1968 All of the foregoing references rely upon either full-sole outer soles, or partial-sole attachments, provided in either case with means for attachment to a regular boot or shoe.

Customarily such attachments are by means of straps. In other cases the attachment means employs toe and/or heel embracing hoods or caps. Where straps are employed, the outer soles are customarily of the sandal-type, wherein the sole is generally planar, and the toe and heel of the wearer's boot are exposed.

The present invention concerns a full-sole outer sole. Such an item of footwear should be light and durable. It should remain firmly in position during use, while being sufficiently pliable to permit a wearer to walk comfortably, in the normal way. These features are present in a sandal-type outer sole that is made from a flexible, resilient material such as rubber.

A problem arises, however, when a thin sandal-type format is adopted for such outer soles. Because the sandal-type sole is preferably thin (to enhance flexibility and reduce weight) and is not attached to the toe or heel of the principal boot by a hood or cap, the sandal-type sole does not readily lie against the wearer's boot. Instead small gaps open, both at the heel and toe while walking.

A problem associated with such gaps is that they tend to collect snow or dirt. This is particularly true at the toe, due to the forward motion of the foot, and the inclined angle of the foot just as it is being picked up to be swung forward.

The accumulation of snow between the outer sole and the boot is irritating for the wearer. Once snow has so accumulated, the foot no longer lies in its natural orientation during walking. Under pressure the accumulated snow may give-way, causing a momentary loss, or irregularity, of support for the wearer's foot. At minimum, this is an anxiety-creating event.

The present invention is directed to providing an outer sole of the sandal-type, for use over pre-existing footwear or boots, that is adapted to minimize the accumulation of snow or dirt between the toe of the boot and the front-end of the outer sole. Provision is also made for the accumulation of snow or dirt at the heel to be minimized. Optionally, such outer soles may be cleated to improve their traction on ice.

The invention in its general form will first be described, and then its implementation in the form of specific embodiments will be detailed with reference to the drawings following hereafter. These embodiments are intended to demonstrate the principle of the invention, and the manner of its implementation. The invention will then be further described, and defined, in each of the individual claims which conclude this specification.

SUMMARY OF THE INVENTION

The invention consists of an outer sole for wearing over footwear having toe and heel portions, such outer-sole having toe and heel regions corresponding to the toe and heel portions of the footwear wherein the toe region of the outer sole is curled upwards in the absence of said footwear to press against the toe portion of the footwear when the outer sole is attached thereto.

This curl in the outer sole may be achieved by providing a sole comprising:

(1) a generally planar flexible lower tread element having toe and heel regions corresponding to the toe and heel portions of said footwear;

(2) an elastically extensible, generally planar, upper footwear-contacting, sole element bonded to the upper surface of the tread element;

(3) attachment means, which may be in the form of straps, for attaching the outer sole to the lower surface of the aforesaid footwear, wherein the said upper sole element is elastically extended in the toe region of the outer sole to thereby cause the toe region of the outer sole to be curled upwards in the absence of footwear, and to press against the toe portion of the footwear when the outer sole is attached thereto. "Planar" as used above, and throughout this patent Specification, means that the tread and upper sole elements are relatively thin in comparison with their longitudinal and lateral dimensions, being predominantly two dimensional and capable of being aligned with a plane, although they need not always be so aligned.

By a further feature of the invention, the upper sole element of the outer sole may be elastically extended in the heel region of the outer sole to thereby cause such heel region to be curled upwards in the absence of the footwear, and to press against the heel portion of the footwear when the outer sole is attached thereto. This effect may be similarly obtained in the manner analogous to that described above for the toe region.

To provide lateral bending rigidity to the outer sole in combination with lateral support, the lower surface of the tread element may be provided with a series of transverse, protruding ridges, which may optionally rise in height as proceeding from the lateral edges of the outer soles to a maximum height at about to the longitudinal center line of the outer soles. Such ridges should accommodate the ready flexing of the outer sole along lines transverse to its length. This is accomplished by separating such ridges by inter-ridge spacing that extend fully across the width of the outer sole.

These ridges may be provided in combination with a series of elevated posts, distributed along both sides of said outer sole proximate to its lateral edges, such posts protruding to a height which is substantially the same as the maximum height of the most proximate ridge. In this manner a tread may be provided to improve traction on soft surfaces; and provision made to receive metal studs on the ends of the elevated posts to improve traction on ice.

By a further feature of the invention, said posts may be provided with studs in the form of self-tapping metal screws that are affixed to the ends of such studs.

By reason of the curled feature of this outer-sole as described, a means is provided for avoiding the deficiencies recited above in the introduction. Particularly, the toe and heel regions of the outer sole will press against the wearer's boot resisting the opening of small gaps between the footwear and the toe and heel regions of the outer sole while walking. This will serve to resist the entry and accumulation of snow or dirt between the footwear and the outer sole.

The foregoing summarizes the principal features of the invention. The invention may be further understood by the description of the preferred embodiments, in conjunction with the drawings, which now follow.

DESCRIPTION OF THE PREFERRED EMBODIMENTS

Figure 1:
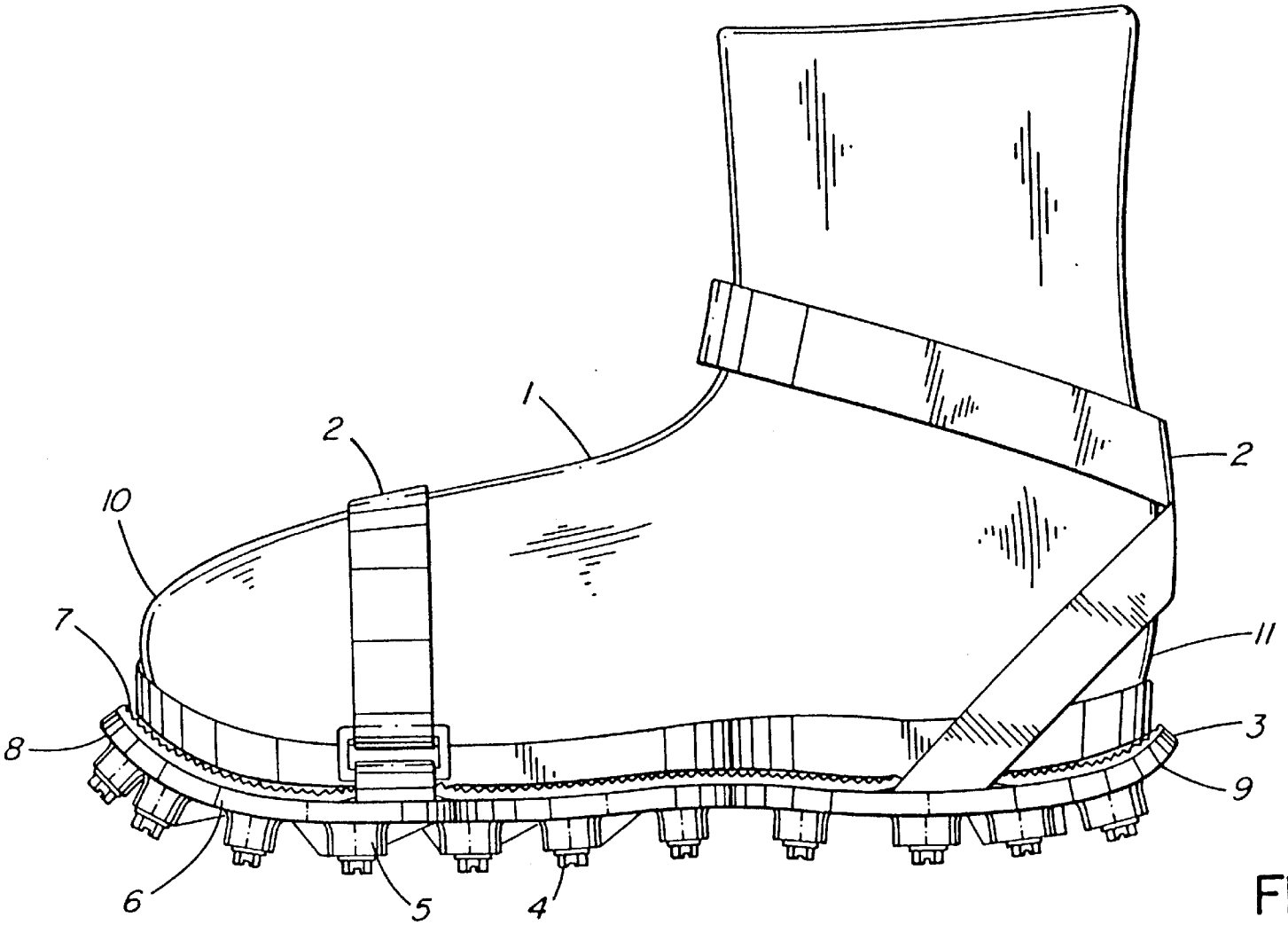
FIG. 1 is a side view of a boot with an outer sole made in accordance with the invention attached thereto.

In FIG. 1 a boot 1 is shown attached by straps 2 to an outer-sole 3. The outer sole 3 has metal studs 4 attached to posts 5 descending from the lower tread element 6 of the outer sole. An upper sole element 7 lies bonded to the tread element 6, suitably by glue, sonic welding or the equivalent. Upwardly-curled toe 8 and heal 9 portions regions of the outer-sole 3 lie in contact with the toe 10 and heel 11 portions of the boot, pressing preferentially into such portions.

Figure 2:
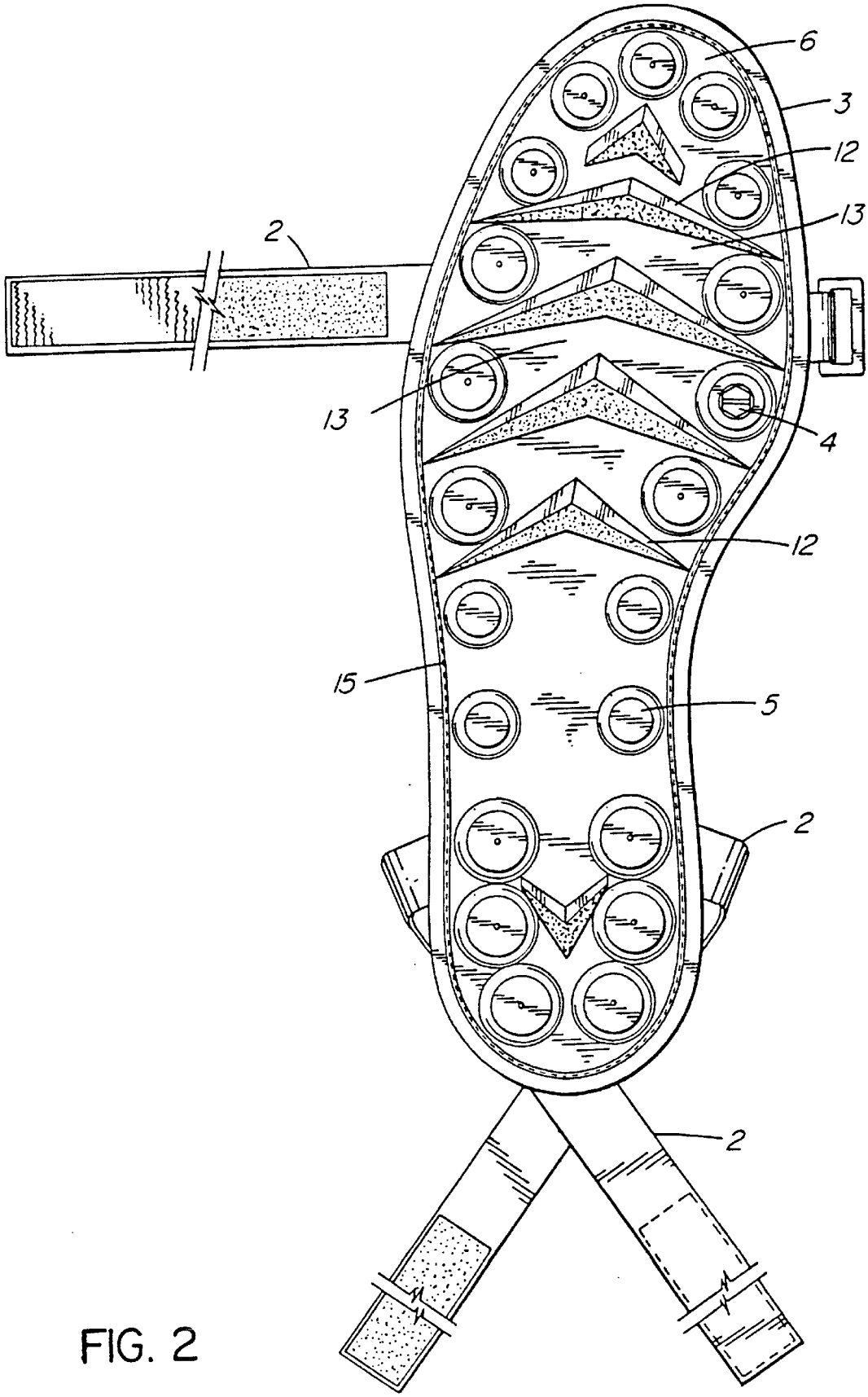
FIG. 2 is a plan view of the outer sole, viewed from the tread side, and with the attachment straps spread out.

In FIG. 2 the tread element 6 of the outer-sole 3 is shown to have transverse ridges 12 which are, in this example, chevron-shaped. Any other shapes adapted to provide traction on soft-soil will be suitable, the chevron format being known to release mud and snow readily. Such ridges 12 are separated by inter-ridge gaps 13 that extend across the entire width of the outer-soles 3 and allow the outer-sole 3 to flex.

Posts 5 carry metal studs 4 which may conveniently be self-tapping metal screws. The height of each post 5 is substantially the same as the maximum height of the most proximate ridge 12.

Figure 3:
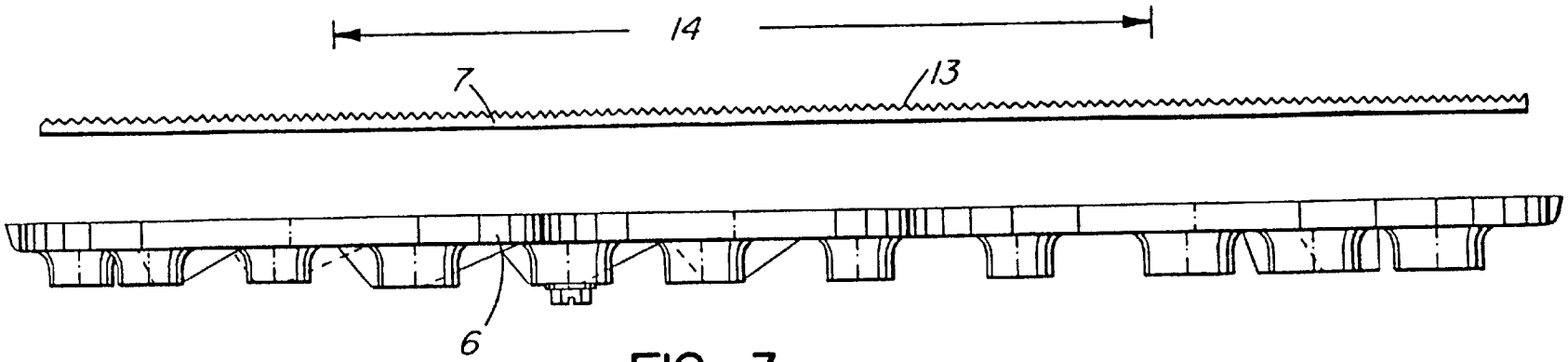
FIG. 3 is an exploded side view of the lower tread portion of the outer sole with the upper portion above, shown before attachment without straps attached and with a single sample stud installed.
Figure 4:
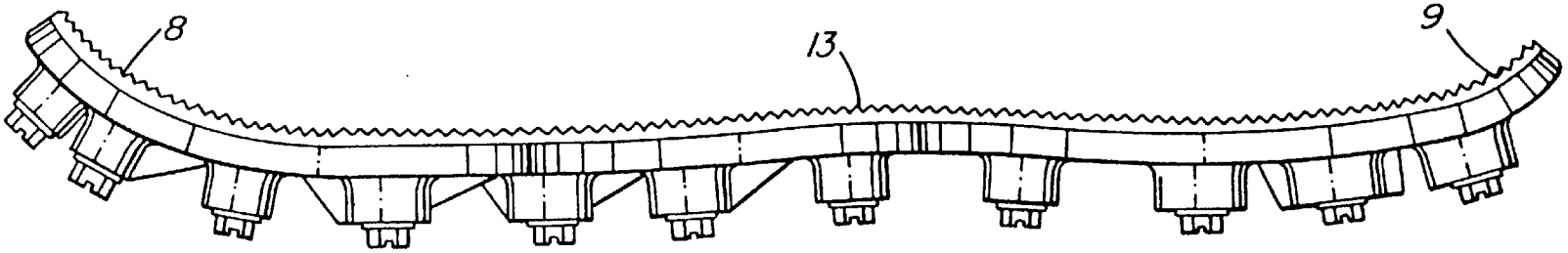
FIG. 4 is a side view of the complete outer-sole standing alone, unattached to footwear and the straps removed.

In FIG. 3 the upper sole 7 and lower tread 6 elements of the outer-sole 3 are shown before assembly. The upper sole element 7 may be made of a thin rubber sheet or equivalent, textured on its upper surface 13 to better engage the lower sole surface of the boot 1.

The upper sole element 7, which may be of 3 mm thickness, is shown as being slightly shorter than the lower tread element 6. This is to allow for stretching during the manufacturing process. On a sole of overall length of 23 cm, it has been found satisfactory for the upper sole element 7 to be shortened by about ½ cm at each end.

In assembling the upper and lower sole and tread elements 7, 6, together, the central region 14 of the sole element 7 is first bonded to the tread element 6, conveniently by contact cement. On a 23 cm sole this central region 14 may extend over 10–14 cm.

After this initial bonding has set, the upper sole element 7 is stretched in its toe and heel regions and then glued, as by contact cement, to the toe and heel regions 8, 9 of the outer sole 3. This causes the toe and heel regions 8, 9 of the outer sole 3 to curl upwards, and this configuration is allowed to remain until the bonding sets. The upper and lower sole and tread elements 7, 6 are then stitched together by stitching 15, around their outer margins.

As can be seen in FIG. 1, the effect of the curled portions is to press the toe and heel regions 8, 9 of the outer sole 3 against the lower sole of the boot 1, in the vicinity of its toe and heel portions 10, 11 of the boot 1.

It has been found that the combined strengths of the materials and degree of stretching in the upper sole element 6 should produce an up-turn, at the toe and heel regions of the outer sole 3, to an angle of about 55 degrees ±5 degrees.

The foregoing has constituted a description of specific embodiments showing how the invention may be applied and put into use. These embodiments are only exemplary, The invention in its broadest, and more specific aspects, is further described and defined in the claims which now follow.

The embodiments of the invention in which an exclusive property or privilege is claimed are defined as follows:

1. An outer sole for wearing over footwear having toe and heel portions, such outer sole being flexible and having toe and heel regions corresponding to the toe and heel portions of the footwear wherein the toe region of the outer sole is curled upwards in the absence of the footwear, to press preferentially against the toe portion of the lower surface of the footwear when the outer sole is attached thereto to resist the entry and accumulation of snow or dirt between the footwear and the outer sole.

2. An outer-sole as in claim 1 wherein the heel region of of the outer sole to of the outer sole is curled upwards in the absence of the footwear to press preferentially against the heel portion of the lower surface of said footwear when the outer sole is attached thereto to resist the entry and accumulation of snow or dirt between the footwear and the outer sole.

3. An outer-sole as in claim 1 wherein the outer sole has a lower surface and such lover surface is provided with a series of transverse, protruding ridges which rise to a maximum height at about the longitudinal center line of the outer sole, and are separated by inter-ridge spacings that extend fully across the width of the outer-sole and accommodate the ready flexing of the outer sole along lines transverse to its length.

4. An outer-sole as in claim 2 wherein the outer sole has a lower surface and such lower surface is provided with a series of transverse, protruding ridges which rise to a maximum height at about the longitudinal center line of the outer sole, and are separated by inter-ridge spacings that extend fully across the width of the outer-sole and accommodate the ready flexing of the outer sole along lines transverse to its length.

5. An outer-sole as in claim 3, comprising additionally a series of elevated posts, distributed along both sides of said outer sole proximate to its lateral edges, such posts protruding to a height which is substantially the same as the maximum height of the most proximate ridge.

6. An outer-sole as in claim 4, comprising additionally a series of elevated posts, distributed along both sides of said outer sole proximate to its lateral edges, such posts protruding to a height which is substantially the same as the maximum height of the most proximate ridge.

7. An outer-sole as in claim 5 wherein self-tapping metal screws are mounted in the ends of said elevated posts to provide traction on ice and snow.

8. An outer-sole as in claim 6 wherein self-tapping metal screws are mounted in the ends of said elevated posts to provide traction on ice and snow.

9. An outer sole as in claim 1 wherein the toe region of the outer sole is curled upwardly to an angle of between 50 and 60 degrees.

10. An outer sole as in claim 2 wherein the toe region of the outer sole is curled upwardly to an angle of between 50 and 60 degrees.

11. An outer sole as in claim 3 wherein the toe region of the outer sole is curled upwardly to an angle of between 50 and 60 degrees.

12. An outer sole as in claim 4 wherein the toe region of the outer sole is curled upwardly to an angle of between 50 and 60 degrees.

13. An outer sole as in claim 5 wherein the toe region of the outer sole is curled upwardly to an angle of between 50 and 60 degrees.

14. An outer sole as in claim 6 wherein the toe region of the outer sole is curled upwardly to an angle of between 50 and 60 degrees.

15. An outer sole as in claim 7 wherein the toe region of the outer sole is curled upwardly to an angle of between 50 and 60 degrees.

16. An outer sole as in claim 8 wherein the toe region of the outer sole is curled upwardly to an angle of between 50 and 60 degrees.

* * * * *